US006400113B1

(12) United States Patent
Garcia et al.

(10) Patent No.: US 6,400,113 B1
(45) Date of Patent: Jun. 4, 2002

(54) APPARATUS AND METHOD FOR MONITORING FAN SPEEDS WITHIN A COMPUTING SYSTEM

(75) Inventors: Ray Garcia, Boca Raton; Will E. Hamel, Parkland; Kendall A. Honeycutt, Boca Raton; Stephen E. Still, Lake Worth, all of FL (US)

(73) Assignee: International Business Machines Corporation, Armonk, NY (US)

( * ) Notice: Subject to any disclaimer, the term of this patent is extended or adjusted under 35 U.S.C. 154(b) by 135 days.

(21) Appl. No.: 09/619,235

(22) Filed: Jul. 19, 2000

(51) Int. Cl.[7] ..... H02P 5/00; G01P 3/489

(52) U.S. Cl. ..... 318/463; 318/268; 318/464; 388/912; 324/166

(58) Field of Search ..... 318/268, 461, 318/463, 464, 600, 601, 602, 603, 606, 607, 434; 388/903, 907.5, 909, 912; 324/160, 161, 166

(56) References Cited

U.S. PATENT DOCUMENTS

| | | | | |
|---|---|---|---|---|
| 4,052,646 A | * | 10/1977 | Massey et al. | 318/39 |
| 4,110,676 A | * | 8/1978 | Edick et al. | 322/31 |
| 4,206,392 A | * | 6/1980 | Shimajiri et al. | 318/602 |
| 4,275,342 A | * | 6/1981 | Kawada et al. | 318/490 |
| 4,638,230 A | * | 1/1987 | Lee | 318/632 |
| 5,534,854 A | | 7/1996 | Bradbury et al. | 340/648 |
| 5,610,594 A | | 3/1997 | Baumann et al. | 340/658 |
| 5,727,928 A | | 3/1998 | Brown | 417/44.11 |
| 5,790,430 A | | 8/1998 | Steiert | 364/565 |
| 5,864,653 A | | 1/1999 | Tavallaei et al. | 315/181 |
| 5,906,315 A | | 5/1999 | Lewis et al. | 236/49.3 |
| 5,926,386 A | | 7/1999 | Ott et al. | 364/175 |
| 5,966,511 A | | 10/1999 | Temma | 395/184.01 |
| 5,990,582 A | | 11/1999 | Henderson et al. | 307/139 |
| 6,262,549 B1 | * | 7/2001 | Yang et al. | 318/463 |

OTHER PUBLICATIONS

Paul Horowitz and Winfield Hill, "The Art of Electronics," Second Edition, Cambridge University Press, 1989, pp. 507–509.

Peter Norton and John Goodman, "Inside the PC," Eighth Edition, SAMS, 1999, pp. 304, 465–466, 622–624.

* cited by examiner

*Primary Examiner*—Bentsu Ro
(74) *Attorney, Agent, or Firm*—Ronald V. Davidge; Richard A. Tomlin

(57) ABSTRACT

Apparatus for monitoring fan speeds within a computing system includes a tachometer turning with the fan, providing a tachometer signal including a number of pulses during each revolution of the fan. This tachometer signal is provided as an input to a signal generator in the form of a flip-flop, which generates a square-wave signal having transitions between high and low levels corresponding to tachometer signal pulses. The square-wave signals are provided as inputs to separate input ports of a microprocessor. These input ports are sequentially sampled at a rate providing at least two samples per period of the fastest square-wave signal, so that transitions of each square wave signal during a predetermined time interval can be detected and counted. For each input port, the number of counted transitions is compared to a stored acceptable value to establish whether the fan is operating in an acceptable speed range.

20 Claims, 2 Drawing Sheets

APPARATUS AND METHOD FOR MONITORING FAN SPEEDS WITHIN A COMPUTING SYSTEM

BACKGROUND INFORMATION

1. Field of Invention

This invention relates to a method for monitoring the operation of one or more cooling fans within a computing system, and, more particularly, to a method for continuously monitoring the operation of a number of fans within the system, with a minimum increase in hardware requirements and with a minimum impact on processor operation.

2. Description of the Related Art

Computing systems typically use one or more fans to provide cooling for critical components producing heat during system operation. The failure of such a fan may result in serious damage to computer hardware, along with a loss of data, due to overheating of the component. Many fans manufactured for use in cooling electronic equipment include an internal tachometer which provides one or more pulses during each revolution of the fan. These tachometer pulses can be used to determine the operating speed of the fan, and, in accordance with their absence, the fact that the fan is not turning.

The patent literature describes a number of methods for determining when a cooling fan within a computing system has failed by stopping or by running at too low a speed. For example, U.S. Pat. No. 5,727,928 describes a fan speed monitoring system for interfacing a fan, including a fan drive and sensing circuit for maintaining the voltage of the fan's Thermal Fan Speed Control (TFSC) pin above a minimum voltage level to maintain continuous power to the fan. The signal driving the TFSC pin controls the width of pulses driving a Pulse Width Modulated (PWM) fan. The fan drive and sensing circuit preferably includes an isolation resistor so that fan pulses exerted by the tachometer within the fan unit are superimposed on the TFSC pin. In the preferred embodiment, a control circuit activates the fan drive and sensing circuit and receives the filtered pulse signals for determining a time value indicative of the speed of the fan.

U.S. Pat. No. 5,534,854 describes a detection and alarm circuit for protecting electronic components cooled by an electronically commutated direct current fan motor, which produces current pulses at various rotational positions during operation. The frequency of these current pulses is used to determine the speed of rotation of the fan. Within the detection and alarm circuit, a current sensing resistor produces a pulse that is amplified and introduced to a frequency-to-voltage convertor for generating a filtered and processed voltage level for application to a voltage comparator. A reference voltage circuit supplies a voltage level to the comparator for matching with the filtered and process voltage level, and, depending on the mismatch, an output signal is introduced to a transistor switch for operating an alarm device.

U.S. Pat. No. 5,790,430 describes a variable speed fan failure detector for detecting the failure of a motor to maintain a commanded speed, which varies as a function of temperature. The failure detector develops a first voltage proportional to motor speed, senses a temperature at a point where a predetermined temperature is to be maintained, and develops a second voltage proportional to a desired speed based on the sensed temperature. The failure detector compares the first and second voltages and provides an alarm output if the first voltage drops below the second voltage.

U.S. Pat. No. 5,610,594 describes a counter to which a frequency to be monitored is taken for the continuous measurement of the cycle time of the frequency. The counter is so set that, when this frequency drops, it reaches a certain condition and issues error signals (flags) as long as the condition lasts. The first flag actuates a flip-flop which in turn actuates a timer (alarm counter) which, after a short time, triggers an alarm unless it has previously been stopped by the resetting of the flip-flop. This apparatus can be used to monitor the speed of a fan, when a speed reduction from normal operating conditions for a short time is not normally harmful, but when such a reduction in speed for a longer time indicates that an alarm signal should be issued to indicate that the fan should be replaced.

While the patents described above provide for reliable detection of a fan failure, what is needed is a method for detecting such a failure in any of a number of fans in a computing system, with a minimum amount of hardware associated with each such fan.

Conventional computing systems now include a System Management Bus (SMBUS), which is used to transmit data between a system controller, particularly a "Northbridge" chip, and Dual In-line Memory Modules (DIMMs). The System Management Bus is also called the $I^2C$ (Inter-Integrated Circuit) Bus. This bus has been developed because there are many different types of memory modules which can fit within the same DIMM sockets. The system controller sends a command along the System. Management Bus to the DIMMs, and the DIMMs, provided they are equipped with Serial Presence Detect circuitry, respond with information describing the capacity of each DIMM, its technology, and the fastest speed at which it can be safely clocked. The System Management Bus is also used with other resources, such as a laptop computer battery having circuits for providing information used to determined the expected life of the battery as it is being operated without recharging.

The problem of detecting and acting upon a number of different failure mechanisms within a computing system is discussed in U.S. Pat. No. 5,864,653, which describes the use of a system management module (SMM) for a host server system. The SMM includes a system management processor (SMP) connected to a system management local bus, which in turn connects to the system PCI bus through a system management central (SMC). The SMC includes logic to monitor PCI cycles and to issue error signals in the event of a system error. The SMC also isolates failed components by making request, grant, and interrupt lines for the failed device. Further, if a spare component is provided, the SMC permits dynamic switching to the spare.

What is needed is a method for coupling the detection of a failure among a number of cooling fans in a computing system together with other system management data for use by a controller within the computing system.

SUMMARY OF THE INVENTION

In accordance with one aspect of the invention, apparatus is provided for monitoring operation of a fan within a computing system. The apparatus includes a tachometer, a signal generator, sampling means, counting means, and comparison means. The tachometer includes a rotor turning with the fan to produce a tachometer output signal including a train of pulses, with a frequency of the pulses within the train of pulses being proportional to a rotational speed of the fan. The signal generator generates a square-wave signal in response to the tachometer output signal, with the square-wave signal being alternately at a high level or at a low level between sequentially adjacent transitions. The sampling means is for periodically sampling levels of the square wave signal. The counting means is for counting transitions in levels of the square wave signals during a predetermined time period by examining levels of samples taken by the sampling means. The comparison means is for comparing numbers of transitions determined by the counting means with a predetermined acceptable value.

The sampling and counting means are preferably embodied within a processor, including an input port through which the square-wave signal is delivered, executing a program for determining if a frequency of pulses in the square wave signal is within a predetermined range, wherein the program includes a first subroutine for periodically sampling the square wave signal and for counting transitions in levels of the square-wave signal within a predetermined time period by examining levels of samples taken by the sampling means and a second subroutine for comparing a number of the transitions with a predetermined value for the number of the transitions.

The present invention is readily applied to monitoring operation of a number of fans, with the output of a tachometer turning with each fan being applied as an input to the signal generator. The square-wave signal from each signal generator is directed toward an individual input port of the processor. The program executing within the processor causes these input ports to be sampled sequentially, with the process of sampling all ports being repeated until the predetermined time period has elapsed.

In accordance with another aspect of the present invention, a method is provided for monitoring operation of a fan within a computing system, with the method including steps of:

forming a train of tachometer pulses having a frequency proportional to a rotational speed of the fan;

generating a square-wave signal in response to the train of tachometer pulses, wherein the square wave signal includes a transition generated in response to each of the pulses within the train of pulses; and wherein the square wave signal is alternately at a high level or at a low level between sequentially adjacent transitions;

periodically sampling levels of the square-wave signal;

counting transitions in levels of the square-wave signal within a predetermined time period by examining levels taken during periodical sampling; and comparing a number of counted transitions with a predetermined acceptable value.

DESCRIPTION OF THE INVENTION

Figure 1:
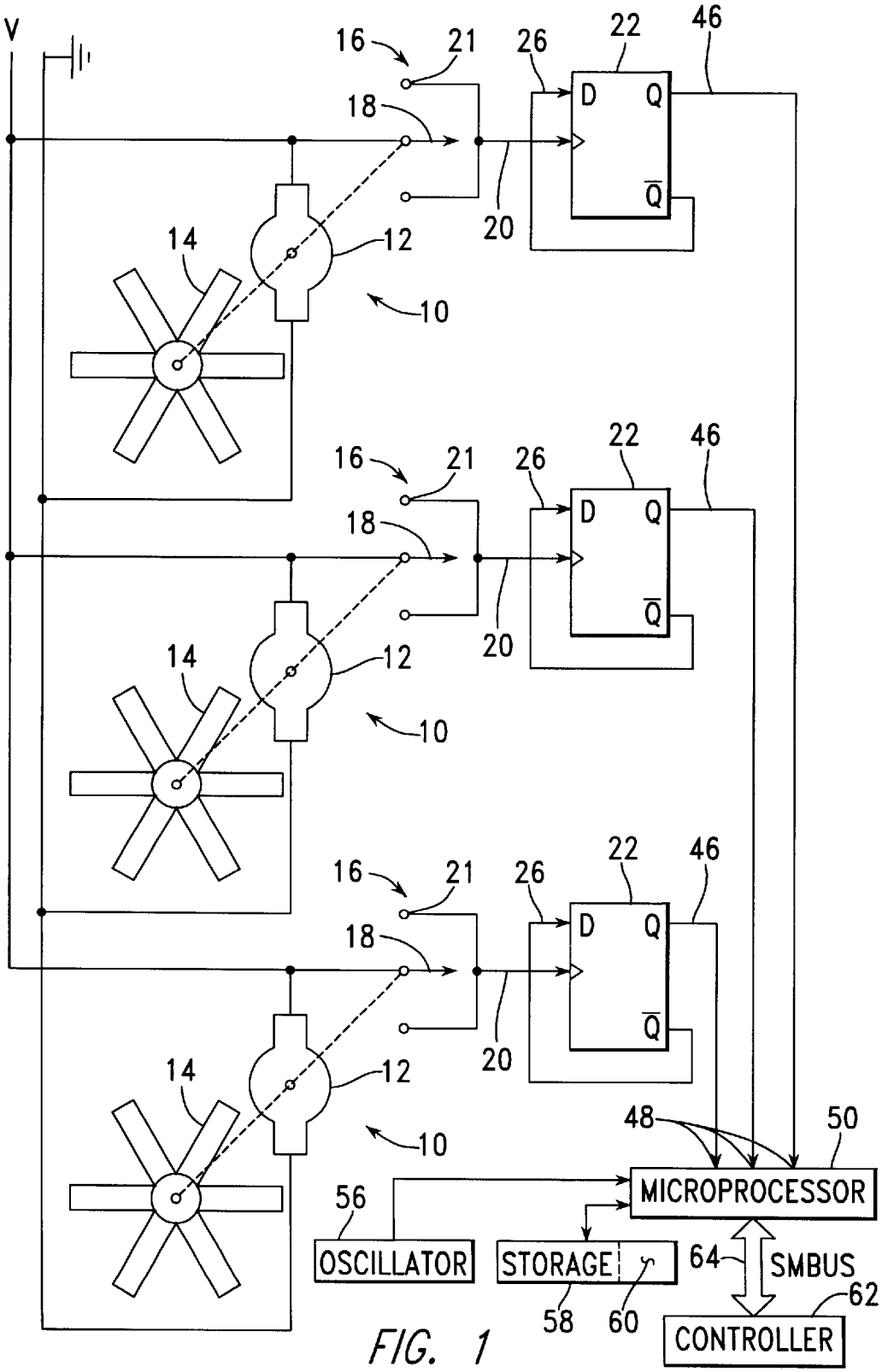
FIG. 1 is a schematic view of apparatus for detection of cooling fan failures built in accordance with the present invention.

FIG. 1 is a schematic view of apparatus for detecting the failure of a cooling fan 10 within a computing system. There are typically a number of cooling fans 10, three of which are shown in the example of the figure, each of which has a potential for causing significant damage to a particular device being cooled in the event of a failure. The failure of such a device may also result in a loss of data. Each fan 10 can fail, for example, due to a failure of its internal electronic circuitry, of the external circuitry driving the fan, or due to wear or other damage to the bearings supporting fan rotation. It is therefore particularly desirable to monitor operation of each cooling fan 10 in a manner providing for alarm and shut down procedures in the event of a fan failure, regardless of its cause.

Each cooling fan 10 includes a motor 12, a blade assembly 14 turning with the motor 12, and a tachometer 16, also turning with the motor 12. The motor 12 may be driven at a constant voltage, or its speed may be controlled in response to the output of tachometer 16 or in response to a measured temperature. While in the example of the figure, the motor 12 is driven at a constant DC voltage, V, each motor 12 may be driven by a separately controlled DC voltage or by an AC voltage. The tachometer 16 includes a rotor 18 causing a short-duration voltage pulse to be transmitted along an output line 20 each time the rotor 18 passes a contact 21. Thus, a particular integral number of pulses, two in the example of the drawing, are transmitted along the output line 20 during each revolution of the fan 10. Thus, the frequency of the pulses on line tachometer output line 20, or the time duration between sequentially occurring pulses, provides an accurate indication of the rotational speed of the fan 10.

Figure 2:
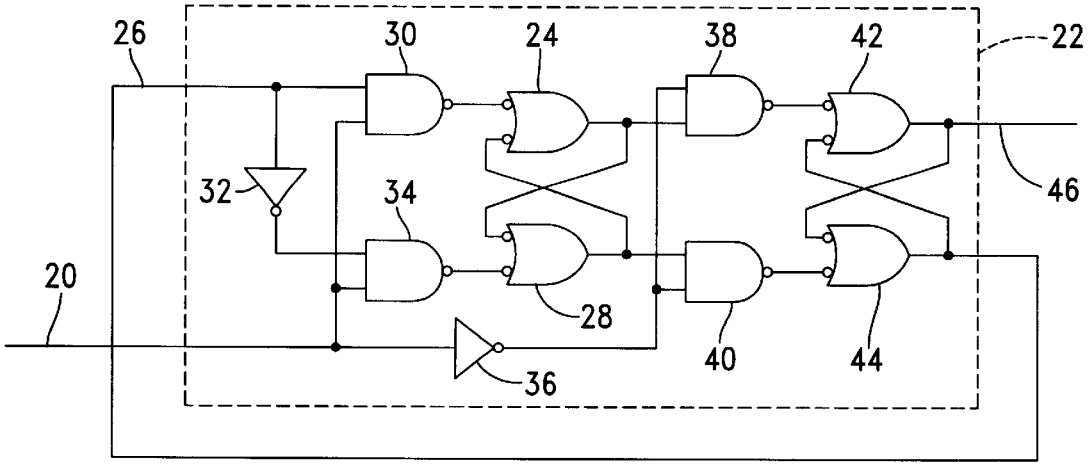
FIG. 2 is a schematic view of a flip-flop circuit within the apparatus of FIG. 1.

FIG. 2 is a schematic view of a flip-flop 22, to which the tachometer output line 20 is provided as a clock input. The flip-flop 22 is of a type having a first master element 24 which stores the value applied to the data input line 26 upon the rising edge of a pulse along the tachometer output line 20, and a second master element 28, which stores the complement of the value applied to the data input line 26 upon the rising edge of a pulse along the line 20. In this way, the flip-flop 22 is used as a signal generator to generate a square-wave signal.

Referring to FIGS. 1 and 2, when the signal on the tachometer output line 20 is high, during a pulse from the tachometer 16, and when the signal on the data input line 26 is also high, the output of the first master element 24 is driven to a high level through NAND gate 30, and this output of element 24, together with complement of the data input signal, being applied through an invertor and through a NAND gate 34, drives the output of the second master element 28 to a low level. Then, when the signal on the tachometer output line 20 is low, following a pulse from the tachometer 16, with NAND gates 30, 34 being held at a high level, the output of the first master element 24 is held at a high level from the low output level of the second master element 28, and the output of the second master element 28 is held at a low level from the high output level of the first master element 24.

Similarly, when the signal on the tachometer output line 20 is high, and when the signal on the data input line is low, the output of the second master element 28 is driven to a high level through the invertor 32 and through the NAND gate 34, and this output of element 28, together with the data signal on line 26, being applied through NAND gate 30, drives the output of the first master element 24 to a low level. Then, when the signal from the tachometer output line 20 is low, the output of the second master element 28 is held at a high level from the low output level of the first master element 24, and the output of the first master element 24 is held at a low level from the high output level of the second master element 28.

The signal applied to the tachometer output line 20 is inverted by an invertor 36 for application as an input to each of the NAND gates 38, 40 driving slave elements 42, 44. Thus, the output of the first slave element 42 is set according to the output of the first master element 24 through NAND gate 38, and the output of the second slave element 44 is set according to the output of the second master element 28, during the absence of a pulse from the tachometer 16. When such a pulse is present, the NAND gates 38, 40 are disabled, with the output of the first slave element 42 being held at a predetermined level by the complimentary level of the output from the second slave element 44, and with the output of the second slave element 44 similarly being held at a predetermined level by the complimentary level of the output from the first slave element 42.

Since the output of the second slave element 44 is connected to the data input line 26, this arrangement causes the output signal from the first slave element 42 to be a square wave, having high level pulses separated by intervening low levels, with both the pulses and the intervening low levels being equal in duration. When the output signal from the first slave element 42 is high, the corresponding low output signal from the second slave element 44 sets the output of the first master element 24 to a low level with the rise of a pulse from the tachometer 16. Then, with the end of this pulse from the tachometer 16, the low level of the first master element 24 sets the output of the first slave element 42 at a low level. Similarly, when the output of the first slave element 42 is low, the corresponding high output signal from the second slave element 44 sets the output of the first master element 24 to a high level with the rise of a pulse from the tachometer 16. Then, with the end of this pulse, the high level of the first master element 24 sets the output of the first slave element 42 at a high level. The output of the first slave element 44 is also the output of the flip-flop 22, which is applied through a line 46 as an input to an input port 48 of a microprocessor 50.

A flip-flop 22 is electrically connected to the output of a tachometer 18 within each of the cooling fans 10. Each of the flip-flops 22 operates as described above to provide a square wave output signal indicating the actual speed of the fan 10 to which it is connected. Each of these square-wave output signals is connected by a line 46 to a different input port 48 of the microprocessor 50. A program executing within the microprocessor 50 causes the various input ports 48 to be repeatedly and sequentially sampled.

Figure 3:
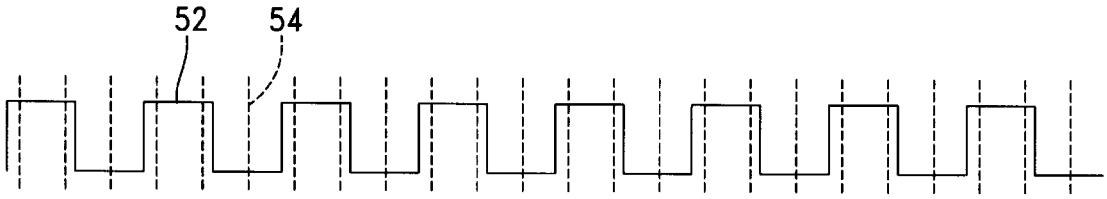
FIG. 3 is a graphical view of a sampling process occurring within a microprocessor in the apparatus of FIG. 1.

FIG. 3 is a graphical view of the sampling process, with the square-wave output signal 52 of one of the flip-flops 22 being sampled at an input port 48 at times indicated by dashed lines 54. In the example of the figure, the input port 48 is sampled three times during each period of the signal (i.e. during adjacent high and low segments of the square wave). This sampling rate is sufficient to detect every transition of the square wave from a low level to a high level and from a high level to a low level. That is, each such transition occurs between sequentially adjacent sampling times. On the other hand, if sampling occurs at a rate producing fewer than two samples during the period duration of the square wave, it is possible that a first transition of the signal from a first level to a second level and a second transition returning to the first level can both occur between sequentially adjacent sampling times. The occurrence of such an event would result in an incorrect determination of the frequency of the square wave, with an entire pulse being missed. Therefore, sampling occurs at a frequency producing at least two samples during the period duration of the highest-frequency square wave anticipated in the application. As long as this condition is met, the same number of transitions are measured, regardless of the sampling rate.

The microprocessor 50 operates at a clock frequency established by an oscillator 56. As described above, this clock frequency is fast enough to assure that the highest-frequency square wave output of a flip-flop 22 is sampled at least twice during its period.

The microprocessor 50 also has access to storage 58, which stores instructions for a program executing within the microprocessor 50, together with parameters to be used within the program and data developed during the execution of the program. The program executing within the microprocessor 50 counts the number of transitions occurring from a low level to a high level for each of the input ports 48 during the period of a sampling time, which is, for example 0.05 seconds. Sampling occurs sequentially among the input ports 48, with the process of sampling all input ports 48 being repeated until the sampling time is over. This process establishes a count of signal transitions during this sampling time for each of the input ports 48. Then, this. count is compared to maximum and minimum acceptable levels for the count, stored within a table 60 in the storage 58, any failures detected by variation outside these levels is reported, and the process of counting the transitions is again started. The table 60 may store different levels corresponding to each of the input ports 48. This program includes a first subroutine, called THISREAD, for reading samples of the data available at the various input ports 48 and for counting transitions from the low and to high levels in the sampled square-wave signals and a second subroutine, called COMPARE, for comparing the number of counted transitions of at each input port 48 with predetermined minimum and maximum level for the particular input port 48. This program is represented by the pseudo-code listings in TABLE I:

TABLE I

```
Setup 0.05-second timer and LASTREAD to zero.
THIS READ
THISREAD = Read input port
XOR_RESULT = Exclusive OR (XOR) of THISREAD and LASTREAD
FAN_POINT = loop from 0 to last fan
BIT_TESTER = 2 raised to the power of FAN_POINT (1, 2, 4, 8, . . . n)
COUNT_FAN = XOR_RESULT AND BIT_TESTER
If COUNT_FAN = 1, then FAN_REGISTER(FAN_POINT) =
  FAN_REGISTER(FAN POINT) + 1
Next FAN_POINT
LASTREAD = THISREAD
If timer is done the go to COMPARE, else go to THISREAD again.
COMPARE
FAN_POINT = loop from 0 to last fan
FANERROR(FAN_POINT) = 1 if FAN_REGISTER(FAN_POINT) <
  FAN_MIN(FAN_POINT) OR FAN_REGISTER(FAN_POINT) >
  FAN_MAX(FAN_POINT)
go to THISREAD
```

If the number of input ports 48 available in the microprocessor 50 is greater than the number of cooling fans 10 to be measured, the table storing maximum and minimum acceptable levels for transition counts may store, for comparison with a count at each unused input port 48, a minimum acceptable level of zero and a maximum level corresponding to a square-wave frequency level higher than that which can be expected, so that an error condition is never reported for a count established for the unused port 48. Alternately, another table may be established within the storage 58, identifying the unused input ports so that these ports will be skipped during both the counting (THISREAD) and comparison (COMPARE) subroutines.

The comparison subroutine sets a variable FANERROR (FAN_POINT) equal to one if the counted number of transitions FAN_REGISTER(FAN_POINT) is below a minimum level given by the variable FAN_MIN(FAN_POINT) or above a maximum level given by the variable FAN_MAX(FAN_POINT). The maximum level may be exceeded due to a failure of a speed control circuit driving the fan 10, or if the fan 10 includes a centrifugal fan which speeds up to an unloaded operating condition when its air path is blocked. If such conditions are not possible, reporting an error due to overspeed can be prevented by making the stored maximum unachievably high or by modifying the subroutine to compare only with the minimum level.

The microprocessor 50 is preferably connected to a controller 62 by means of a System Management Bus 64. The controller 62 is, for example, a Northbridge chip connected to the central processor 66 of the computing system by means of a front-side bus 68. The System Management Bus 64 is typically an $I^2C$ bus (Inter-Integrated Circuit) bus, which is otherwise used to interrogate memory modules to determine their individual capacity, technology, and the rate at which they can be clocked.

The use of the System Management Bus 64 facilitates the incorporation of the fan failure detection feature of the present invention into conventional system architectures. The program executing in the microprocessor 50 may generate and transmit an interrupt when it is determined that a fan is operating outside the prescribed fan speed, or the controller 62 may periodically interrogate the microprocessor 50 to determine the status of the cooling fans 10, with the program executing in the microprocessor 50 causing a code representing status of the cooling fans 10 to be transmitted along the System Management Bus 64.

The fan failure detection apparatus of the present invention is used, for example, to cause the equipment to be powered down before equipment damage can occur following a fan failure, or to alert the system operator of the problem. A period of time after power-on may be provided for the cooling fans 10 to achieve normal speed before reacting to a detected failure.

While the system has been described in its preferred form or embodiment with some degree of particularity, it is understood that this description has been given only by way of example, and that numerous changes, including the rearrangement of parts, may be made without departing from the spirit and scope of the invention.

What is claimed is:

1. Apparatus for monitoring operation of a fan within a computing system, wherein said apparatus comprises:

a tachometer including a rotor turning with said fan, wherein said tachometer produces a tachometer output signal including a train of pulses, with a frequency of said pulses within said train of pulses being proportional to a rotational speed of said fan;

a signal generator generating a square-wave signal in response to said tachometer output signal, wherein said square-wave signal includes a transition generated in response to each of said pulses within said train of pulses, wherein said square-wave signal is alternately at a high level or at a low level between sequentially adjacent transitions;

sampling means for periodically sampling levels of said square-wave signal;

counting means for counting transitions in levels of said square-wave signal within a predetermined time period by examining levels of samples taken by said sampling means; and comparison means for comparing numbers of transitions determined by said counting means with a predetermined acceptable value.

2. The apparatus of claim 1, wherein said signal generator includes a flip-flop generating said square-wave signal, alternating high and low levels being set in response to each of said pulses within said train of pulses.

3. The apparatus of claim 1, wherein said sampling means samples said square-wave signal at a frequency providing at least two samples per period of said square-wave signal.

4. Apparatus for monitoring operation of a fan within a computing system, wherein said apparatus comprises:

a tachometer including a rotor turning with said fan, wherein said tachometer produces a tachometer output signal including a train of pulses, with a frequency of said pulses within said train of pulses being proportional to a rotational speed of said fan;

a signal generator generating a square-wave signal in response to said tachometer output signal, wherein said square-wave signal includes a transition generated in response to each of said pulses within said train of pulses, wherein said square-wave signal is alternately at a high level or at a low level between sequentially adjacent transitions;

a processor, including an input port through which said square-wave signal is delivered, executing a program for determining if a frequency of pulses in said square wave signal is within a predetermined range, wherein said program includes a first subroutine for periodically sampling said square wave signal and for counting transitions in levels of said square-wave signal within a predetermined time period by examining levels of samples taken by said sampling means and a second subroutine for comparing a number of said transitions with a predetermined value for said number of said transitions.

5. The apparatus of claim 4, wherein said signal generator includes a flip-flop generating said square-wave signal, alternating high and low levels being set in response to each of said pulses within said train of pulses.

6. The apparatus of claim 4, wherein said square-wave signal is sampled at a frequency providing at least two samples per period of said square-wave signal.

7. Apparatus for monitoring operation of each fan in a plurality of fans within a computing system, wherein said apparatus comprises:

a plurality of tachometers, wherein each of said tachometers includes a rotor turning with a fan in said plurality of fans, wherein each said tachometer produces a tachometer output signal including a train of pulses, with a frequency of said pulses within said train of pulses being proportional to a rotational speed of said fan;

a plurality of signal generators, wherein each said signal generator generates a square-wave signal in response to a tachometer output signal, wherein said square-wave signal includes a transition generated in response to each of said pulses within said train of pulses, wherein said square-wave signal is alternately at a high level or at a low level between sequentially adjacent transitions;

a processor, including a plurality of input ports, wherein each of said input ports is connected to an output of a signal generator in said plurality of signal generators, for receiving said square-wave signal, wherein said processor executes a program for determining if a frequency of pulses in each said square wave signal is within a predetermined range, wherein said program includes a first subroutine for periodically sampling each said square wave signal and for counting transitions in levels of each said square-wave signal within a predetermined time period by examining levels of samples taken by said sampling means and a second subroutine for comparing a number of said transitions with a predetermined value for said number of said transitions for each said input port.

8. The apparatus of claim 7, wherein said square-wave signals at said plurality of input ports are sampled sequentially during said predetermined time period.

9. The apparatus of claim 7, wherein each said signal generator includes a flip-flop generating said square-wave signal, alternating high and low levels being set in response to each of said pulses within said train of pulses.

10. The apparatus of claim 7, wherein said square-wave signal is sampled at a frequency providing at least two samples per period of said square-wave signal.

11. The apparatus of claim 7, wherein said apparatus additionally comprises data storage accessed by said processor, said data storage stores a table of values for said predetermined value, each element in said table of values corresponds to an input port within said plurality of input ports, and a number of said transitions measured at each input port within said plurality thereof is compared with a value for said predetermined value corresponding to said input port.

12. The apparatus of claim 7, wherein said apparatus additionally comprises data storage accessed by said processor, said data storage stores a table of values for said maximum and minimum levels of said predetermined value, each element in said table of values corresponds to an input port within said plurality of input ports, and a number of said transitions measured at each input port within said plurality thereof is compared with maximum and minimum values for said predetermined value corresponding to said input port.

13. The apparatus of claim 7, wherein said processor is connected to a controller within said computing system through a bus, and said program executing within said processor causes an interrupt to be transmitted along said bus in response to a determination that said number of transitions falls outside a range defined by said predetermined value corresponding to said input port.

14. The apparatus of claim 7, wherein said processor is connected to a controller within said computing system through a bus, and said program executing within said processor causes status information to be transmitted in response to a command from said controller.

15. A method for monitoring operation of a fan within a computing system, wherein said method comprises steps of:

forming a train of tachometer pulses having a frequency proportional to a rotational speed of said fan;

generating a square-wave signal in response to said train of tachometer pulses, wherein said square wave signal includes a transition generated in response to each of said pulses within said train of pulses; and wherein said square wave signal is alternately at a high level or at a low level between sequentially adjacent transitions;

periodically sampling levels of said square-wave signal;

counting transitions in levels of said square-wave signal within a predetermined time period by examining levels taken during periodical sampling; and comparing a number of counted transitions with a predetermined acceptable value.

16. The method of claim 15, wherein said step of periodically sampling levels of said square-wave signal occurs at a frequency providing at least two samples per period of said square wave signal.

17. A method for monitoring operation of a plurality of fans within a computing system, wherein said method comprises steps of:

for each fan within said plurality of fans, forming a train of tachometer pulses having a frequency proportional to a rotational speed of said fan;

for each said train of tachometer pulses, generating a square-wave signal in response to said train of tachometer pulses, wherein said square wave signal includes a transition generated in response to each of said pulses within said train of pulses; and wherein said square wave signal is alternately at a high level or at a low level between sequentially adjacent transitions;

providing each said square-wave signal as an input to a separate input port of a processor;

periodically sampling levels of said square-wave signal at each said separate input port;

counting transitions in levels of said square-wave signal at each said separate input port within a predetermined time period by examining levels taken during periodical sampling; and comparing a number of counted transitions of said square-wave signal at each separate input port with a predetermined acceptable value.

18. The method of claim 17, wherein said step of periodically sampling levels of said square-wave signal at each said separate input port occurs at a frequency providing at least two samples per period of said square wave signal.

19. The method of claim 17, wherein said step of comparing a number of counted transitions is followed, in response to a determination that said number of counted transitions is outside a predetermined range of acceptable numbers of transitions, by transmitting an interrupt along a bus to a controller within said computing system.

20. The method of claim 17, additionally comprising a step, in response to a command, of transmitting a code indicating whether said number of counted transitions of said square-wave signal for a separate input port is outside a predetermined range of acceptable numbers of transitions.

* * * * *